United States Patent [19]

Marion

[11] Patent Number: 4,826,355

[45] Date of Patent: May 2, 1989

[54] METHOD FOR TRANSPORTING AND TRANSFERRING A HEAVY LOAD IN HIGH SEAS TO A FIXED STRUCTURE

[75] Inventor: Henri-Albert Marion, Boullay, France

[73] Assignee: Modular Jack-Up Systems Company, Inc., Panama, Panama

[21] Appl. No.: 239,007

[22] Filed: Aug. 30, 1988

Related U.S. Application Data

[63] Continuation of Ser. No. 2,759, Dec. 10, 1986, abandoned.

[30] Foreign Application Priority Data

Apr. 24, 1985 [FR] France ..... 85 06232

[51] Int. Cl.[4] ..... E02B 17/00

[52] U.S. Cl. ..... 405/209; 405/195; 405/204

[58] Field of Search ..... 114/259

[56] References Cited

U.S. PATENT DOCUMENTS 2,997,852 8/1961 Suderow ..... 405/209 X 3,593,529 7/1971 Smulders ..... 405/209

4,055,264 10/1977 Abbott ..... 405/209 X

FOREIGN PATENT DOCUMENTS 94434 11/1983 European Pat. Off. ..... 405/209

1214760 11/1959 France ..... 405/209

2008652 6/1979 United Kingdom ..... 405/209

OTHER PUBLICATIONS

Patents Abstracts of Japan, vol. 8, No. 201 (m-325) 1968) Sep. 14, 1984 & JPA 5991209, May 25, 1984.

*Primary Examiner*—Dennis L. Taylor

*Attorney, Agent, or Firm*—Watson, Cole, Grindle & Watson

[57] ABSTRACT

The equipped deck (1) is charged onto a self-elevating platform (2). The platform is positioned close to the fixed platform (11) and the deck is lifted from the self-elevating platform (2) to the level of the fixed platform (11). The deck is slid on the fixed platform (11) by means of a cradle (6) mounted on blocks provided with regulating jacks. The blocks co-operate with sliding ways provided on each of the platforms. The two platforms are coupled by means of a guiding frome (12).

2 Claims, 2 Drawing Sheets

METHOD FOR TRANSPORTING AND TRANSFERRING A HEAVY LOAD IN HIGH SEAS TO A FIXED STRUCTURE

This application is a continuation of application Ser. No. 002,759, filed Dec. 10, 1986, now abandoned.

BACKGROUND OF THE INVENTION

1. Field of the Invention

The invention relates to a method of transporting and transferring the assembled equipment of a deck for the fixed ocean platform, the method involving assembling the equipment at a yard on land, transferring the assembled equipment to means of transport towed to the site, and transferring the assembled equipment to the deck of the platform to be equipped.

2. The Prior Art

The infrastructure of an ocean platform is usually constructed on land in one or more parts, which parts are towed to the site, assembled and then submerged by controlling their buoyancy. The deck is subsequently equipped with the installations corresponding to the intended use of the platform. These installations are produced from modules of standard weights and dimensions, which are assembled together in situ. In seas with normal climatic conditions, the modules are lifted and put in place by means of conventional barge cranes and semi-submersible appliances. On the other hand, the use of these same appliances in seas with difficult climatic conditions does not allow a sufficient level of efficiency to be achieved during the very short periods in which the atmospheric conditions make it possible to work under adequate safety conditions. To reduce the time necessary for lifting the elements and putting them in place and consequently lessen the climatic risks as well as the handling costs and other direct expenses, attempts have been made to increase the lifting capacity of the barge cranes and semi-submersibles, but a limit has been reached, and beyond this the appliances are so costly that they can only be profitable if they are used at a relatively high daily work rate.

Unfortunately, the depreciation of these appliances is only acceptable in a few projects.

There are also serious disadvantages arising from the methods used; thus, the risks inherent in any lifting work at sea increase in proportion to the weight lifted, and there are also the risks involved in transferring a load from a floating appliance to a fixed structure.

Even so, the time necessary for installing the equipment and for testing and accepting it is still not reduced thereby.

The installation work requires a large number of people who have to cope with difficult living conditions heightened by the climatic conditions.

A solution to these problems has been found for some platforms, particularly platforms with a weighted base and self-elevating platforms, this solution involving carrying out the complete installation of the deck and acceptance of the equipment at the construction yard and towing to the site the assembly consisting of the platform and the installed deck.

This method of construction limits the possibilities of use of the platform to those intended initially, and it is not possible, for example, to convert a drilling platform into a production platform in a simple way, since a large part of the installations has to be removed and replaced.

SUMMARY OF THE INVENTION

The method according to the invention is aimed at making it possible to transfer all the equipment necessary for fitting out the deck of a platform, the infrastructure of which is already in place on the site, the equipment being assembled and having received final acceptance at a yard on land.

According to the invention, the transport and transfer of the equipment are carried out from a self-elevating platform capable of being connected, for loading or unloading purposes, to the embarkation quay and to the platform to be equipped.

The explanations and Figures given below by way of example will make it possible to understand how the invention can be put into practice.

DESCRIPTION OF THE DRAWINGS

FIG. 1 illustrates diagrammatically the phase of transferring a complete set of equipment 1 assembled and accepted on land to a self-elevating platform 2. In a known way, the self-elevating platform is moored to the quay 3, so that the means of transfer located on the deck of the platform are approximately in the extension of those of the quay. These means of transfer comprise respectively tracks 4 and rails 5. The cradle 6, which forms part of the means of transfer and which supports the equipment comprising living quarters, technical rooms and, if appropriate, the drilling rig, is mounted on transfer supports composed, for example, of five rows of three skids 7 spaced at a uniform distance from one another over what may appropriately be called the length of the cradle. The spacing of the skids of one and the same row corresponds to the spacing of the rails 5 and tracks 4. The skids are mounted on flat jacks, to make it possible, if appropriate, to transfer the loads from one row of skids to the other rows of skids, as will be described later.

Figure 1:
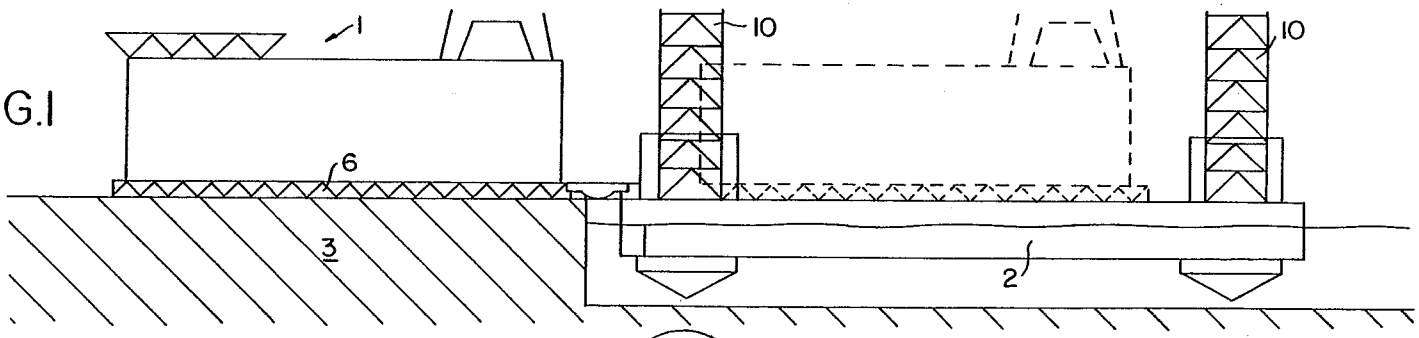
FIG. 1 shows the phase of transferring the equipment from a quay to a self-elevating platform.
Figure 2:
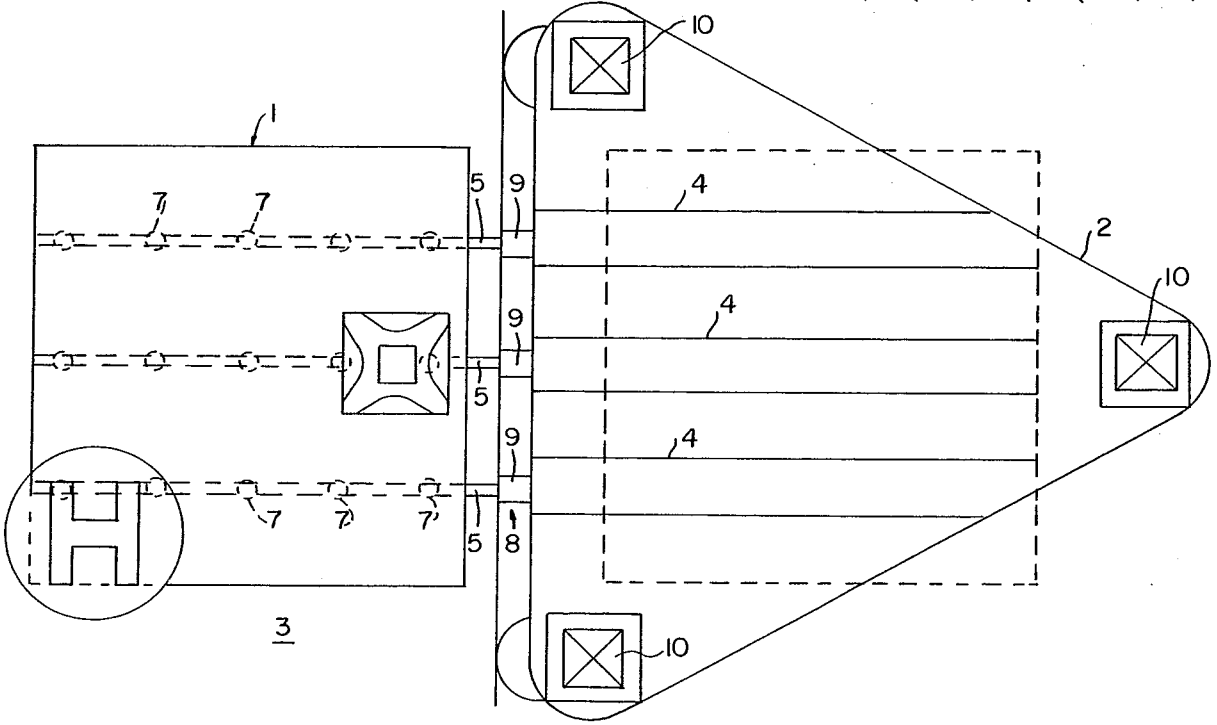
FIG. 2 is a plan view of FIG. 1, showing some of the means of transfer.
Figure 3:
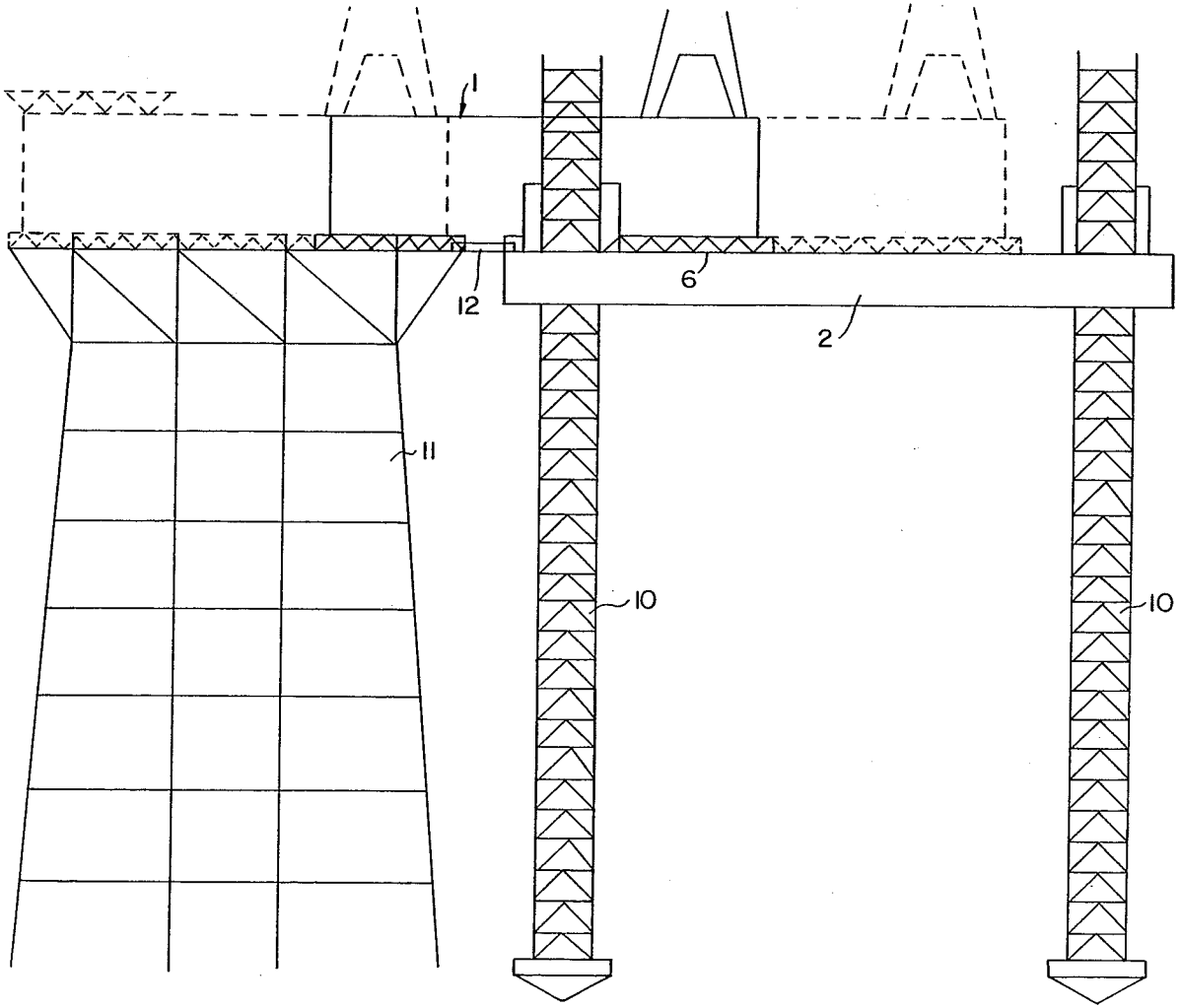
FIG. 3 shows the phase of transferring the equipment from a self-elevating platform to the platform to be equipped.

To ensure at least approximate alignment between the sliding rails 5 and the sliding tracks 4 of the platform, there is a template 8 which is placed between the quay 3 and the deck of the platform 2. This template carries guides 9 which connect the rails 5 to the tracks 4.

In this example, the transfer of the equipment is carried out in a known way by sliding. However, at this stage of the transport process, any other means or methods can be used, if appropriate, even lifting by crane or gantry. Loading, carried out in a generally calm coastal area, does not present any particular difficulties.

The self-elevating transport platform 2 is kept floating in order to receive the load. However, it is possible to have it rest on its feet 10.

During transfer by sliding, the template 8 located between the quay and the platform is prevented from supporting any load.

For this purpose, the load supported by the row of skids, when it reaches the template between the quay 3 and the platform 2, is transferred to the other rows of skids which rest either on the quay or on the self-elevating platform.

When the self-elevating platform 2 is loaded, it is towed to the site and then moored near the fixed platform 11.

The platform 2 is positioned so that its means of transfer are placed approximately in alignment with those provided on the platform 11, and then the deck of the self-elevating platform 2 is lifted level with the deck of the fixed platform 11. The two decks are coupled by means of a guide frame 12, the function of which is to maintain the relative positions of the platforms in relation to one another in the horizontal plane.

The transfer of the load 1 from the self-elevating platform 2 to the fixed platform 11 is carried out in a known way by sliding.

The row of skids engaging on the frame 12 between the two platforms is relieved of the load in favour of the other rows of skids resting on one deck or on both decks.

When the transfer of the load has been completed, the two decks are uncoupled by retracting the guide frame 12.

The self-elevating platform is floated by raising its feet and is available for other uses, and in particular it can be equipped with a crane and living quarters so that, if appropriate, the work can be completed.

It should be noted that the tracks 4 provided both on the fixed platform and on the self-elevating platform are relatively wide in relation to the skids 7 of the cradle 6 carrying the load. This allows a transverse shift of the module during transfer, for example attributable to a fault in the positioning of the tracks of the two decks, and this shift can easily be compensated during the sliding operation.

It is easily possible to change the intended use of the fixed platform by adopting the same method to transfer the equipment from the deck of the fixed platform to the deck of the self-elevating platform and to replace it, during a subsequent transfer, with equipment designed for the new use of the fixed platform.

I claim:

1. A device for transporting and transferring a load comprising a complete set of equipment for a deck of a fixed ocean platform, the load being transported on a self-elevating platform from the construction yard on land to the fixed platform on the site, the device comprising transfer tracks provided at least on the self-elevating transport platform and on the fixed platform to be equipped such that they can be aligned with one another, means of transfer comprising a cradle supporting the load, transfer supports provided under the cradle, said supports comprising a row of skids spaced at a uniform distance from one another by a distance equal to that separating the transfer tracks, the skids having adjusting jacks for controlling the load and the geometry so that transferring loads from one row of skids to another row of skids is possible, and at least one movable guide frame ensuring coupling between the deck of the fixed platform and the self-elevating platform.

2. A method of putting the device according to claim 1 into effect, wherein the row of skids engaging on the guide frame between the two platforms is relieved of the load in favor of the other rows of skids resting on one deck or on both decks.

* * * * *